US006454324B1

(12) United States Patent
Lewis et al.

(10) Patent No.: US 6,454,324 B1
(45) Date of Patent: Sep. 24, 2002

(54) ELECTRONIC DOOR CONTROL AND LIGHT

(76) Inventors: John H. Lewis, 320 Driftwood Dr., Piedmont, SC (US) 29673; John S. Lewis, 320 Driftwood Dr., Piedmont, SC (US) 29673

( * ) Notice: Subject to any disclaimer, the term of this patent is extended or adjusted under 35 U.S.C. 154(b) by 141 days.

(21) Appl. No.: 09/648,131

(22) Filed: Aug. 25, 2000

(51) Int. Cl.[7] ..... E05B 15/02

(52) U.S. Cl. ..... 292/341.16; 292/DIG. 25; 292/DIG. 4; 292/DIG. 12; 70/257; 70/432

(58) Field of Search ..... 292/341.16, DIG. 4, 292/DIG. 12, DIG. 25, DIG. 72; 70/257, 432; 392/100; 49/379, 364

(56) References Cited

U.S. PATENT DOCUMENTS

| | | | | | |
|---|---|---|---|---|---|
| 3,677,043 | A | | 7/1972 | Cox | |
| 4,344,647 | A | * | 8/1982 | Van Der Linden | 292/201 |
| 4,496,942 | A | | 1/1985 | Matsuoka | |
| 4,727,679 | A | | 3/1988 | Kornbrekke et al. | |
| 4,779,171 | A | * | 10/1988 | Ferguson | 362/100 |
| 4,872,095 | A | * | 10/1989 | Dubak et al. | 362/100 |
| 4,896,909 | A | * | 1/1990 | Mauer | 292/201 |
| 4,907,429 | A | | 3/1990 | Davis et al. | |
| 4,972,629 | A | | 11/1990 | Merendino et al. | |
| 5,074,604 | A | * | 12/1991 | Merendino et al. | 292/256.63 |
| 5,076,625 | A | * | 12/1991 | Oxley | 292/201 |
| 5,184,855 | A | * | 2/1993 | Waltz et al. | 292/251.5 |
| 5,499,171 | A | * | 3/1996 | Simpson et al. | 362/100 |
| 5,581,230 | A | * | 12/1996 | Barrett | 116/202 |
| 5,678,436 | A | | 10/1997 | Alexander | |
| 5,729,198 | A | * | 3/1998 | Gorman | 340/539 |
| 5,788,295 | A | * | 8/1998 | Fuss et al. | 292/341.16 |
| 5,790,034 | A | * | 8/1998 | Khoury | 292/144 |
| 5,924,750 | A | * | 7/1999 | Fuss et al. | 292/201 |
| 5,943,888 | A | * | 8/1999 | Lawson | 292/254 |
| 6,035,676 | A | * | 3/2000 | Hudspeth | 292/144 |
| 6,049,287 | A | * | 4/2000 | Yulkowski | 292/251.5 |
| 6,347,485 | B1 | * | 2/2002 | Hebda | 292/341.16 |

* cited by examiner

*Primary Examiner*—J. J. Swann
*Assistant Examiner*—Matthew E. Rodgers

(57) ABSTRACT

An electronic door control and light for permitting push-button and/or remote opening of a door and lighting of an area proximate the doorway. The electronic door control and light includes a control panel assembly designed for coupling to a building, a door latch assembly having a door jarring assembly and a latch mechanism, and at least one light operationally coupled to the control panel assembly. In an embodiment, a remote unit has a transmitter and the control panel assembly has a receiver for selectively activating the door latch assembly and light. In an embodiment, the control panel assembly has individual switches for facilitating selective activation of the door latch assembly and the light.

12 Claims, 5 Drawing Sheets

9
9
12
10
34
20
28
5
32
30

70
28
16
44
29
14
46
23
48
21
75
76
25

ELECTRONIC DOOR CONTROL AND LIGHT

BACKGROUND OF THE INVENTION

1. Field of the Invention

The present invention relates to door opening devices and more particularly pertains to a new electronic door control and light for permitting push-button and/or remote opening of a door and lighting of an area proximate the doorway.

2. Description of the Prior Art

The use of door opening devices is known in the prior art. More specifically, door opening devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,678,436; 4,907,429; 3,677,043; 4,496,942; 4,972,629; and 4,727,679.

While these devices fulfill their respective, particular objectives and requirements, the aforementioned patents do not disclose a new electronic door control and light. The inventive device includes a control panel assembly designed for coupling to a building, a door latch assembly having a door jarring assembly and a latch mechanism, and at least one light operationally coupled to the control panel assembly. In an embodiment, a remote unit has a transmitter and the control panel assembly has a receiver for selectively activating the door latch assembly and light. In an embodiment, the control panel assembly has individual switches for facilitating selective activation of the door latch assembly and the light.

In these respects, the electronic door control and light according to the present invention substantially departs from the conventional concepts and designs of the prior art, and in so doing provides an apparatus primarily developed for the purpose of permitting push-button and/or remote opening of a door and lighting of an area proximate the doorway.

SUMMARY OF THE INVENTION

In view of the foregoing disadvantages inherent in the known types of door opening devices now present in the prior art, the present invention provides a new electronic door control and light construction wherein the same can be utilized for permitting push-button and/or remote opening of a door and lighting of an area proximate the doorway.

The general purpose of the present invention, which will be described subsequently in greater detail, is to provide a new electronic door control and light apparatus and method which has many of the advantages of the door opening devices mentioned heretofore and many novel features that result in a new electronic door control and light which is not anticipated, rendered obvious, suggested, or even implied by any of the prior art door opening devices, either alone or in any combination thereof.

To attain this, the present invention generally comprises a control panel assembly designed for coupling to a building, a door latch assembly having a door jarring assembly and a latch mechanism, and at least one light operationally coupled to the control panel assembly. In an embodiment, a remote unit has a transmitter and the control panel assembly has a receiver for selectively activating the door latch assembly and light. In an embodiment, the control panel assembly has individual switches for facilitating selective activation of the door latch assembly and the light.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electronic door control and light apparatus and method which has many of the advantages of the door opening devices mentioned heretofore and many novel features that result in a new electronic door control and light which is not anticipated, rendered obvious, suggested, or even implied by any of the prior art door opening devices, either alone or in any combination thereof.

It is another object of the present invention to provide a new electronic door control and light that may be easily and efficiently manufactured and marketed.

It is a further object of the present invention to provide a new electronic door control and light which is of a durable and reliable construction.

An even further object of the present invention is to provide a new electronic door control and light which is susceptible of a low cost of manufacture with regard to both materials and labor, and which accordingly is then susceptible of low prices of sale to the consuming public, thereby making such electronic door control and light economically available to the buying public.

Still yet another object of the present invention is to provide a new electronic door control and light which provides in the apparatuses and methods of the prior art some of the advantages thereof, while simultaneously overcoming some of the disadvantages normally associated therewith.

Still another object of the present invention is to provide a new electronic door control and light for permitting push-button and/or remote opening of a door and lighting of an area proximate the doorway.

Yet another object of the present invention is to provide a new electronic door control and light which includes a control panel assembly designed for coupling to a building, a door latch assembly having a door jarring assembly and a latch mechanism, and at least one light operationally coupled to the control panel assembly. In an embodiment, a remote unit has a transmitter and the control panel assembly has a receiver for selectively activating the door latch assembly and light. In an embodiment, the control panel assembly has individual switches for facilitating selective activation of the door latch assembly and the light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
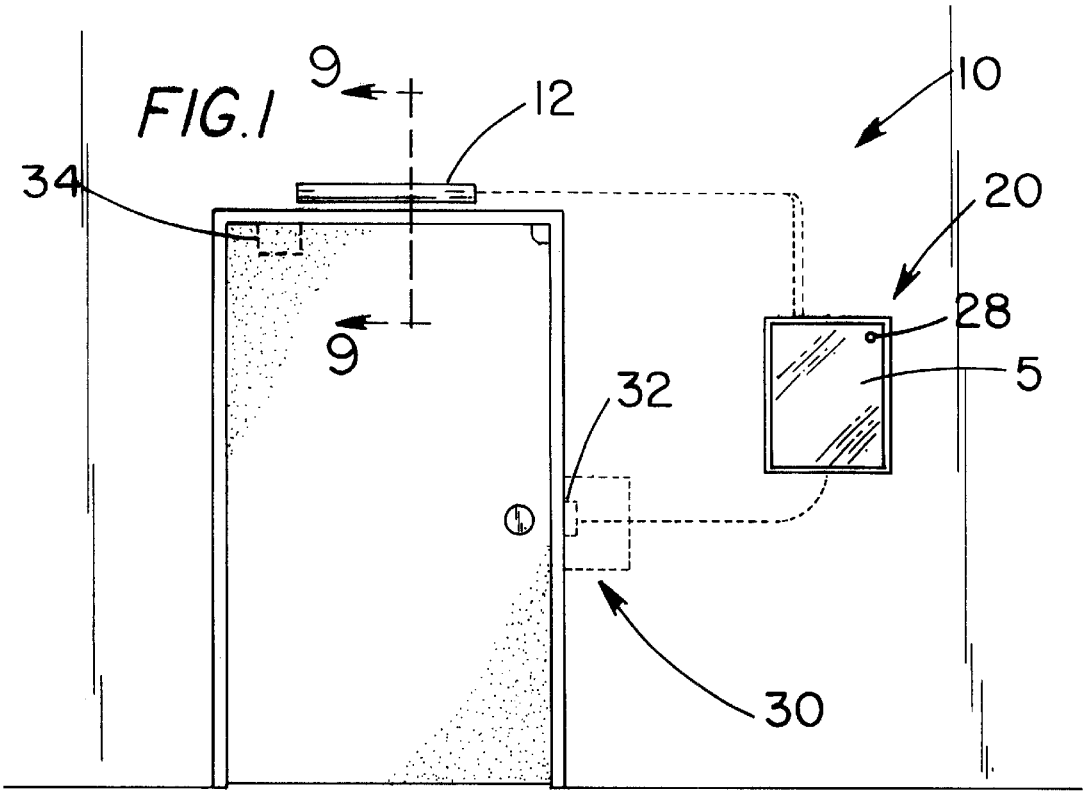
FIG. 1 is a front view of a new electronic door control and light according to the present invention.
Figure 2:
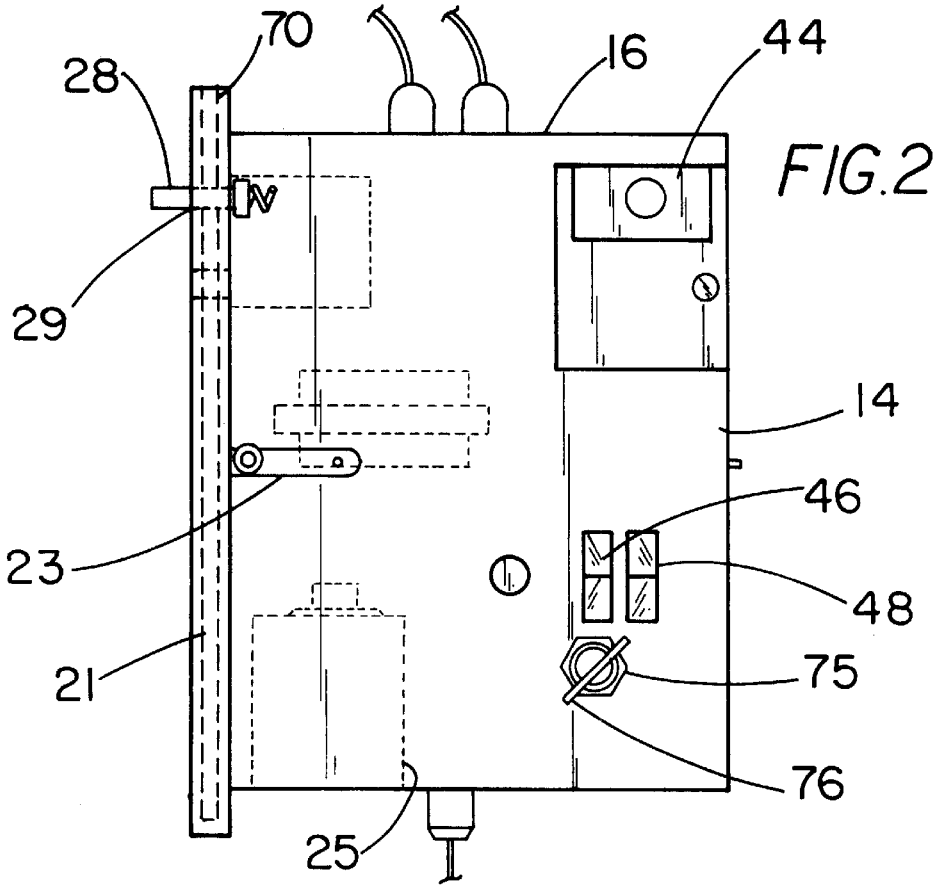
FIG. 2 is a front view of the control panel assembly of the present invention.
Figure 3:
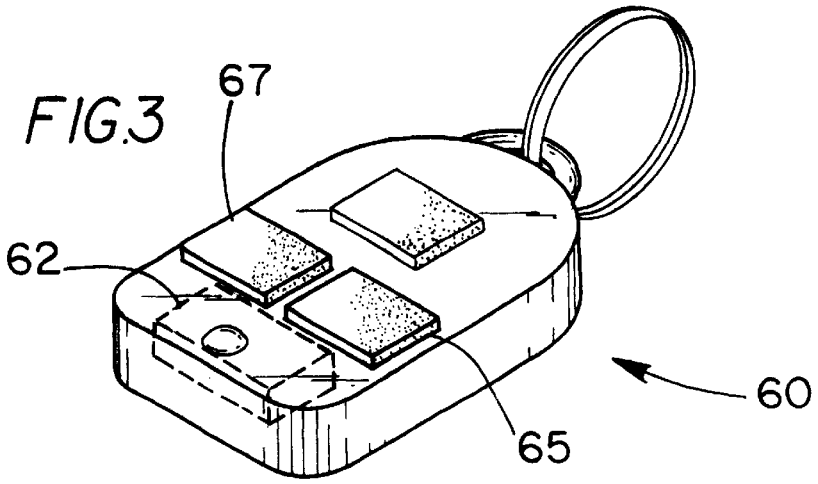
FIG. 3 is a perspective view of an embodiment of the remote control unit of the present invention.
Figure 4:
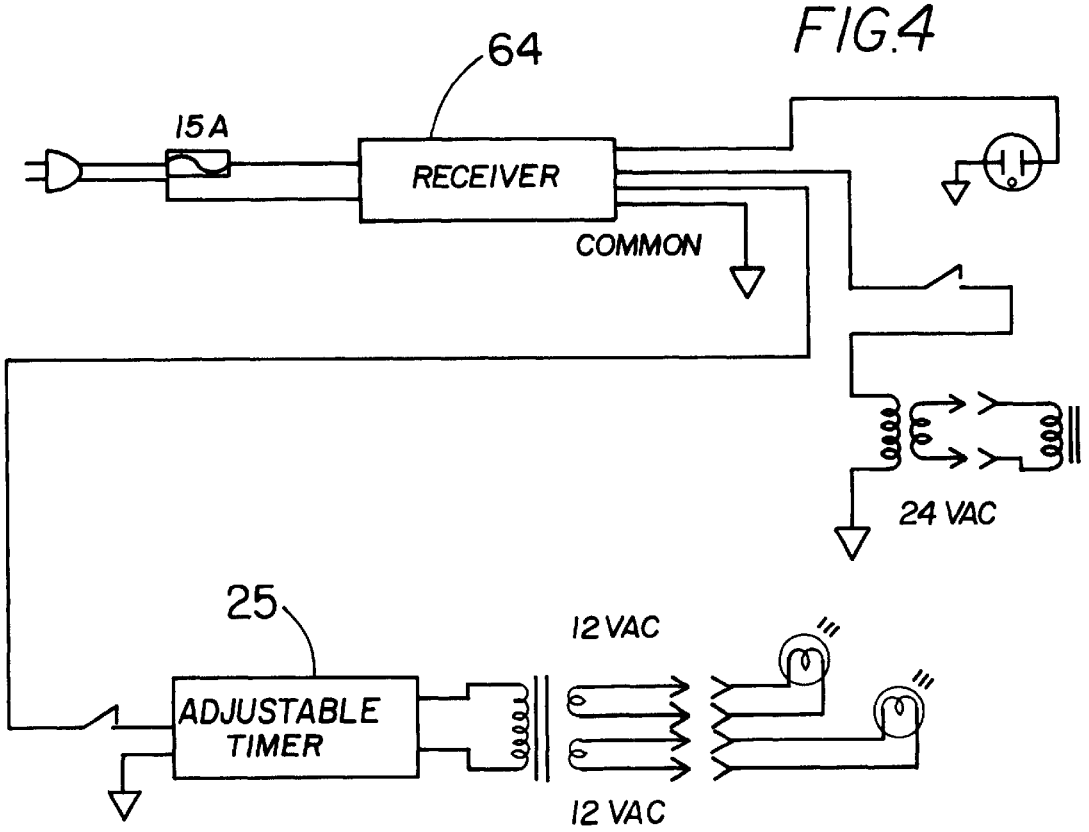
FIG. 4 is a schematic diagram of the circuitry of the present invention.
Figure 5:
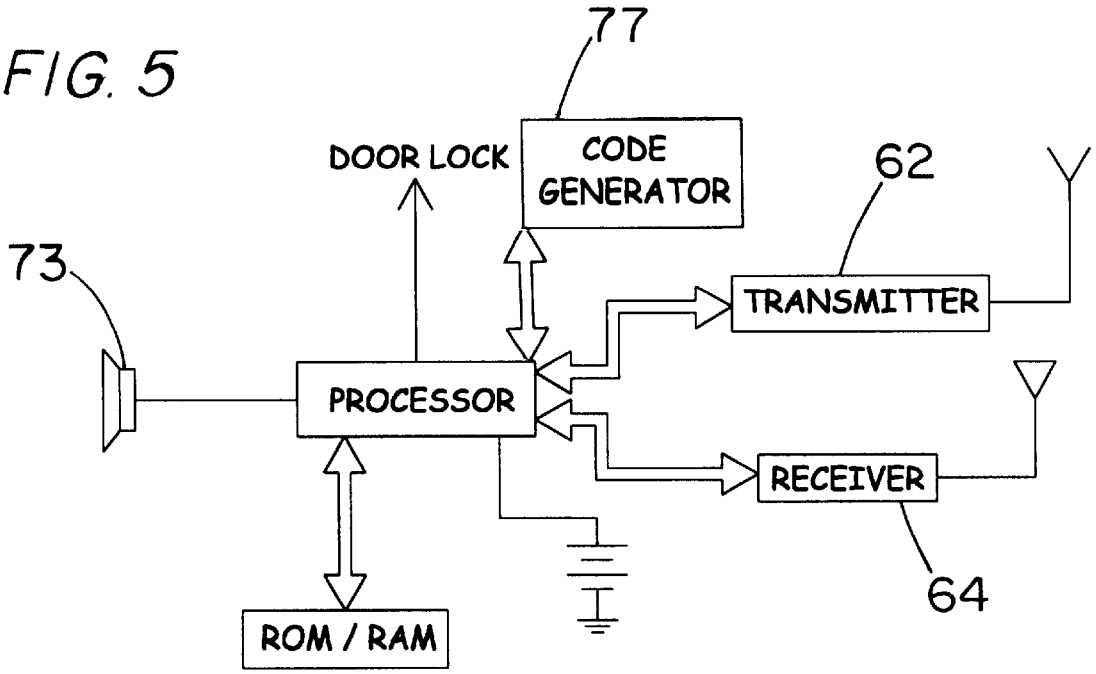
FIG. 5 is a schematic diagram of an embodiment of the present invention.
Figure 6:
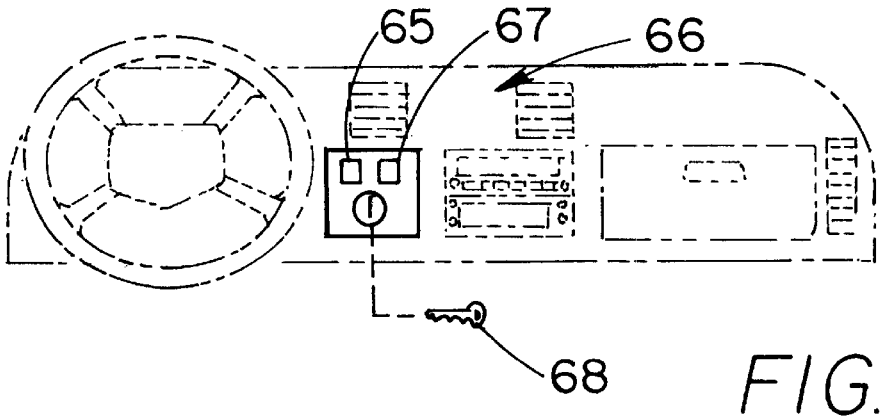
FIG. 6 is a perspective view of an embodiment of the remote control unit of the present invention.
Figure 9:
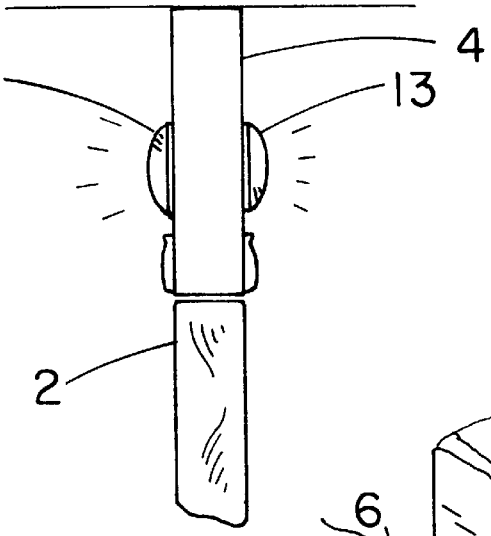
FIG. 9 is a cross-sectional view taken along line 9—9 of FIG. 1.
Figure 10:
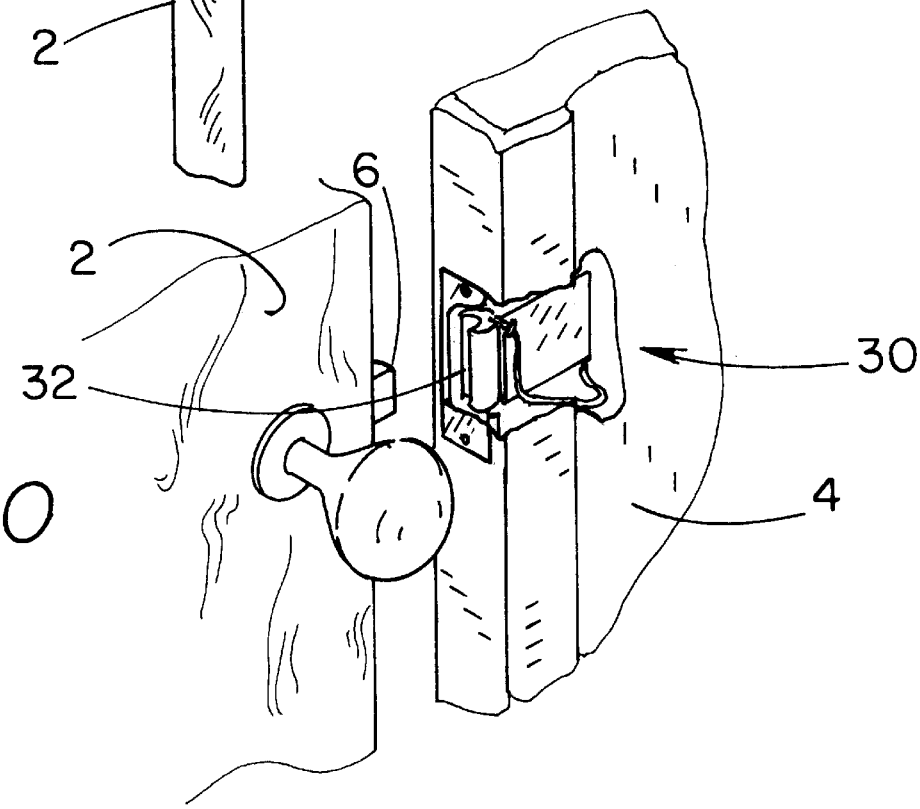
FIG. 10 is a perspective view of the door latch assembly.
Figure 7:
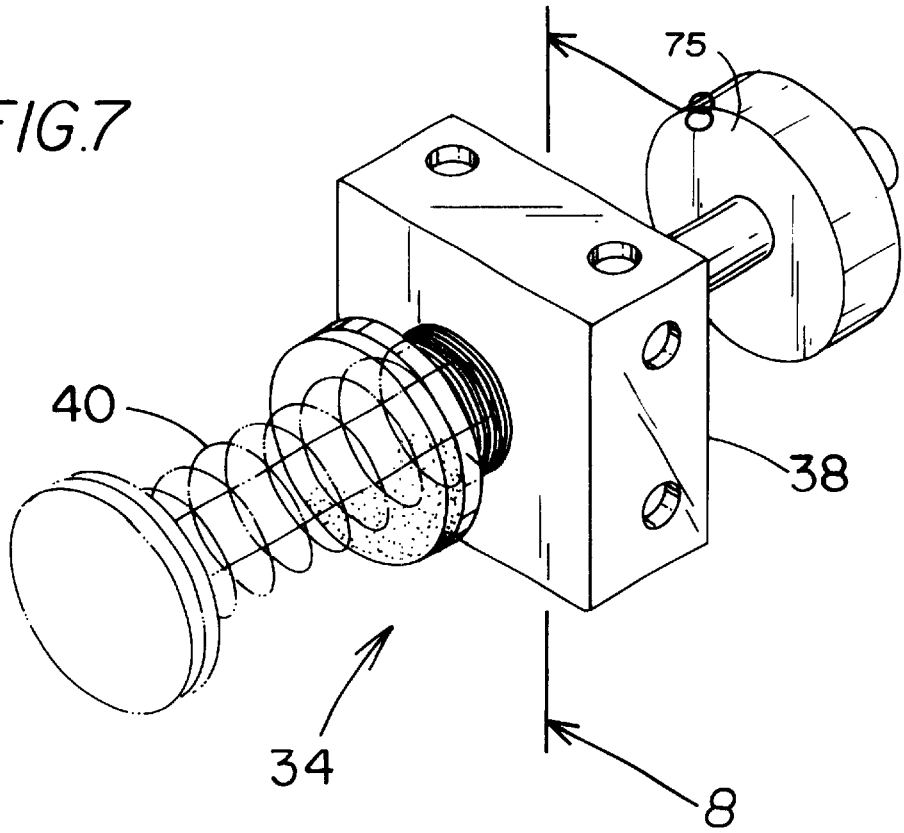
FIG. 7 is a perspective view of the door jarring assembly.
Figure 8:
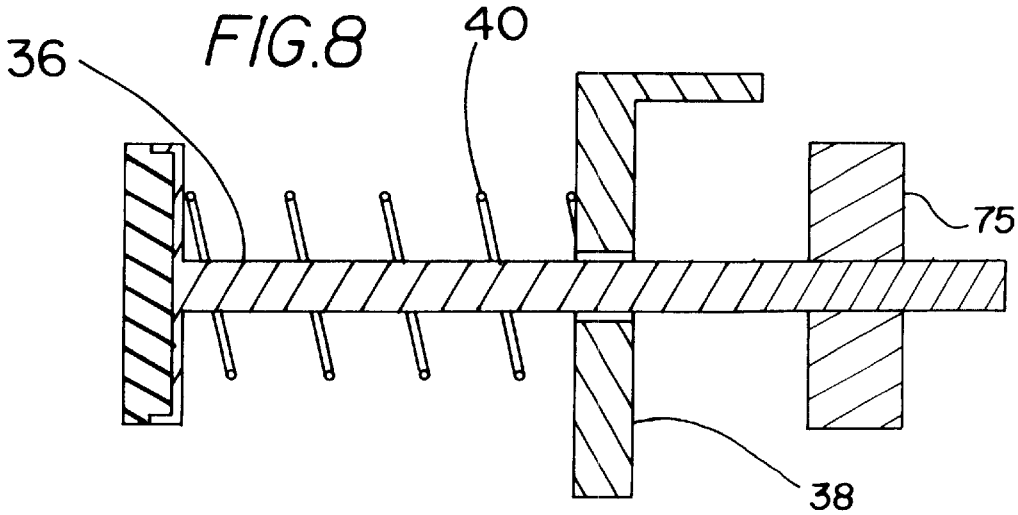
FIG. 8 is a cross-sectional view taken along line 8—8 of FIG. 7.

With reference now to the drawings, and in particular to FIGS. 1 through 10 thereof, a new electronic door control and light embodying the principles and concepts of the present invention and generally designated by the reference numeral 10 will be described.

As best illustrated in FIGS. 1 through 10, the electronic door control and light 10 generally comprises at least one light 12 designed for positioning proximate a door 2 of a structure 4. A control panel assembly 20 is operationally coupled to the light 12 for selectively operating the light 12.

A door latch assembly 30 is designed for coupling to the structure 4 proximate a bolt 6 of the door 2. The door latch assembly 30 is operationally coupled to the control panel assembly 20 for selectively unlocking and opening the door 2. The door latch assembly 30 includes a latch member 32 selectively positionable between a retracted position, wherein the latch member 32 is positioned to permit free movement of the door 2 while the bolt 6 is extended, and an extended position, wherein the latch member 32 is positioned adjacent to the bolt 6 when the door 2 is in a closed position. Thus, the door 2 is prevented from opening when the bolt 6 of the door is extended from the door and the latch member 32 is in the extended position.

The door latch assembly 30 further includes a door jarring device 34 designed for pushing the door 2 open when the latch member 32 is in the open position. The door jarring device 34 includes a main member 36 slidably inserted through a bracket 38. The bracket 38 is designed for coupling to the structure 4 proximate the door 2. The door jarring device 34 also includes a biasing member 40 operationally coupled to the main member 36 for biasing the main member 36 towards the door 2 such that the main member 36 abuts the door 2 and the biasing member 40 is in a compressed position when the door 2 is in a closed position. Thus, the door 2 is urged into an open position by the door jarring device 34 when the latch member 32 is in the retracted position.

In an embodiment, the door jarring device 34 includes an adjuster knob 75 for adjusting the length of extension of the main member 36. Thus, the degree of push provided by the door jarring device 34 is adjustable to permit full opening of the door 2 or no jarring of the door 2 as desired by the user.

A main switch 44 is included in the control panel assembly 20 for actuating the latch member 32 and the light 12.

A light interrupt switch 46 is also provided in the control panel assembly 20 for selectively preventing turning on of the light 12 when the main switch is activated. A latch member interrupt switch 48 is also provided for selectively preventing actuation of the latch member 32 when the main switch is activated. Thus, the user may selectively activate either of or both the light 12 and latch member 32. In an embodiment, the light interrupt switch 46 and latch member interrupt switch 48 are each positioned on a front face 14 of a housing 16 of the control panel assembly 20. Additionally, a main interrupt switch 75 is provided with a removable key 76 for selectively deactivating the control panel assembly.

A push button 50 is provided and operationally coupled to the main switch 44 for facilitating manual lighting and opening of door 2.

In an embodiment, a remote control unit 60 is included. The remote control unit includes a button 65 for operating a transmitter 62 for transmitting an activation signal. A receiver 64 is provided in the control panel assembly 20 for receiving the activation signal whereby the main switch 44 is activated. The remote unit 60 includes a unit locking mechanism 66 having a removable key 68 for selectively activating and deactivating the remote unit 60 for preventing unauthorized use of the remote unit 60. The remote unit 60 may be integrally incorporated into a vehicle or may comprise a hand held unit similar to a garage door opener. In an embodiment, the remote control unit 60 includes a button 67 for opening of a garage door.

The control panel assembly 20 further includes a panel door 21 for covering the front face 14 of the housing 16. A panel door locking mechanism 23 is provided for selectively locking the panel door 21 in a closed position for preventing unauthorized access to the front face 14 of the housing 16. The panel door 21 also includes an indicator light aperture 29 and the control panel assembly 20 includes an indicator light 27 positioned proximate the indicator light aperture 29 such that the indicator light 27 is visible through the indicator light aperture 29. The indicator light 27 is actuated when the main switch 44 is activated.

The panel door 21 also includes a picture holding assembly 70 for holding a picture 5 whereby the panel door 21 resembles a picture frame. The picture holding assembly 70 is for facilitating disguising of the control panel assembly 20. The indicator light 27 may be incorporated into the push button 50 and extended out of the picture or picture holding assembly 70 to permit manual activation of the main switch 44 without opening the panel door 21 or removing the picture 5 from the picture holding assembly 70.

A timer 25 is provided for deactivating the light 12 a predetermined period of time after actuation of the light 12.

In an embodiment a second light 13 is provided. Light 12 is designed for positioning on an exterior of the structure 4 and the second light 13 is designed for positioning in an interior of the structure 4 for providing light proximate the interior and exterior of the door 2 of the structure 4.

In an embodiment, the control panel assembly 20 is also connected to a speaker 73 for emitting an audible sound upon actuation of the main switch 44.

In an embodiment, a code generator 77 is incorporated into the control panel assembly 20 as an added security measure. The code generator generates a changing code and provides that code to the remote control unit to actuate the main switch. Thus, operation of the control panel by another control unit is discouraged.

In use, the latch assembly is positioned to interact with the bolt of the door and at least one light is positioned near the door.

Upon pressing of the push button to activate the main switch or activation of the main switch using a remote control unit, the door is opened and the light is turned on. Thus, the door and light can be operated from a remote location prior to picking up items, the carrying of which might otherwise make manual operation of the doorknob and light switch difficult.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A door lighting and control system comprising:

a light adapted for positioning proximate a door of a structure;

a control panel assembly operationally coupled to said light for selectively operating said light;

a door latch assembly adapted for coupling to the structure proximate a bolt of the door, said door latch assembly being operationally coupled to said control panel for selectively opening the door of the structure;

said door latch assembly having a latch member selectively positionable between a retracted position wherein said latch member is positioned to permit free movement of the door when the bolt of the door is extended from the door and an extended position wherein said latch member is positioned adjacent to the bolt of the door when the door is in a closed position whereby said door is prevented from opening when the bolt of the door is extended from the door;

said door latch assembly further having a door jarring device adapted for pushing the door open when said latch member is in said open position; and wherein said control panel assembly further comprises a main switch for actuating said latch member and said light, a light interrupt switch for selectively preventing turning on of said light when said main switch is activated, and a latch member interrupt switch for selectively preventing actuation of said latch member when said main switch is activated.

2. The door lighting and control system of claim 1, wherein said control panel assembly further comprises:

a push button operationally coupled to said main switch for facilitating manual lighting and opening of door.

3. The door lighting and control system of claim 1, further comprising:

a remote control unit having a transmitter for transmitting an activation signal;

a receiver in said control panel assembly for receiving said activation signal whereby said main switch is activated.

4. A door lighting and control system comprising:

a light adapted for positioning proximate a door of a structure;

a control panel assembly operationally coupled to said light for selectively operating said light;

a door latch assembly adapted for coupling to the structure proximate a bolt of the door, said door latch assembly being operationally coupled to said control panel for selectively opening the door of the structure;

said door latch assembly having a latch member selectively positionable between a retracted position wherein said latch member is positioned to permit free movement of the door when the bolt of the door is extended from the door and an extended position wherein said latch member is positioned adjacent to the bolt of the door when the door is in a closed position whereby said door is prevented from opening when the bolt of the door is extended from the door;

said door latch assembly further having a door jarring device adapted for pushing the door open when said latch member is in said open position;

a remote control unit having a transmitter for transmitting an activation signal;

a receiver in said control panel assembly for receiving said activation signal whereby said main switch is activated; and said remote unit having a unit locking mechanism for selectively activating and deactivating said remote unit for preventing unauthorized use of said remote unit.

5. The door lighting and control system of claim 4, further comprising:

said remote unit being integrally coupled to a dash board of a vehicle for facilitating activation of said main switch by a user positioned within an interior of the vehicle.

6. The door lighting and control system of claim 1, further comprising:

said control panel assembly including a housing, said housing being adapted for coupling to a structure;

said control panel assembly including a panel door for covering a front face of said housing; and a panel door locking mechanism for selectively locking said panel door in a closed position for preventing unauthorized access to said front face of said housing.

7. The door lighting and control system of claim 6, further comprising:

said panel door including an indicator light aperture; and said control panel assembly including an indicator light positioned proximate said indicator light aperture such that said indicator light is visible through said indicator light aperture, said indicator light being actuated when said main switch is activated.

8. The door lighting and control system of claim 6, further comprising:

said panel door including a picture holding assembly for holding a picture whereby said panel door resembles a picture frame, said picture holding assembly being for facilitating disguising of said control panel assembly.

9. The door lighting and control system of claim 1, further comprising:

a timer for deactivating said light a pre-determined period of time after actuation of said light.

10. The door lighting and control system of claim 1, further comprising:

a second light, one light being adapted for positioning on an exterior of the structure and said second light being adapted for positioning in an interior of the structure for providing light proximate the interior and exterior of the door of the structure.

11. The door lighting and control system of claim 1, wherein said door jarring device includes a main member slidably inserted through a bracket, said bracket being adapted for coupling to the structure proximate the door of the structure; and wherein said door jarring device further includes a biasing member operationally coupled to said main member for biasing said main member towards the door such that said main member abuts the door and the biasing member is in a compressed position when the door is in a closed position whereby said door is urged into an open position by said door jarring device when said latch member is in said retracted position.

12. A door lighting and control system comprising:

a light adapted for positioning proximate a door of a structure;

a control panel assembly operationally coupled to said light for selectively operating said light;

a door latch assembly adapted for coupling to the structure proximate a bolt of the door, said door latch assembly being operationally coupled to said control panel for selectively unlocking and opening the door of the structure;

said door latch assembly having a latch member selectively positionable between a retracted position wherein said latch member is positioned to permit free movement of the door when the bolt of the door is extended from the door and an extended position wherein said latch member is positioned adjacent to the bolt of the door when the door is in a closed position whereby said door is prevented from opening when the bolt of the door is extended from the door;

said door latch assembly further having a door jarring device adapted for pushing the door open when said latch member is in said open position;

a main switch for actuating said latch member and said light;

a light interrupt switch for selectively preventing turning on of said light when said main switch is activated;

a latch member interrupt switch for selectively preventing actuation of said latch member when said main switch is activated;

a push button operationally coupled to said main switch for facilitating manual lighting and opening of door;

a remote control unit having a transmitter for transmitting an activation signal;

a receiver in said control panel assembly for receiving said activation signal whereby said main switch is activated;

said control panel assembly including a housing, said housing being adapted for coupling to a structure;

said control panel assembly including a panel door for covering a front face of said housing;

a panel door locking mechanism for selectively locking said panel door in a closed position for preventing unauthorized access to said front face of said housing;

a timer for deactivating said light a pre-determined period of time after actuation of said light;

a second light, one light being adapted for positioning on an exterior of the structure and said second light being adapted for positioning in an interior of the structure for providing light proximate the interior and exterior of the door of the structure;

said remote unit having a unit locking mechanism for selectively activating and deactivating said remote unit for preventing unauthorized use of said remote unit;

said panel door including an indicator light aperture;

said control panel assembly including an indicator light positioned proximate said indicator light aperture such that said indicator light is visible through said indicator light aperture, said indicator light being actuated when said main switch is activated;

said panel door including a picture holding assembly for holding a picture whereby said panel door resembles a picture frame, said picture holding assembly being for facilitating disguising of said control panel assembly;

said remote unit being integrally coupled to a dash board of a vehicle for facilitating activation of said main switch by a user positioned within an interior of the vehicle;

wherein said door jarring device includes a main member slidably inserted through a bracket, said bracket being adapted for coupling to the structure proximate the door of the structure;

wherein said door jarring device further includes a biasing member operationally coupled to said main member for biasing said main member towards the door such that said main member abuts the door and the biasing member is in a compressed position when the door is in a closed position whereby said door is urged into an open position by said door jarring device when said latch member is in said retracted position; and said door jarring device further including an adjustment knob positionable along a length of said main member for selectively preventing extension of a length of said main member whereby a force provided to said door by said door jarring device is adjustable.

* * * * *